US010984748B2

(12) United States Patent
Lu

(10) Patent No.: US 10,984,748 B2
(45) Date of Patent: Apr. 20, 2021

(54) GATE DRIVING CIRCUIT

(71) Applicant: Sitronix Technology Corporation, Jhubei (TW)

(72) Inventor: Hung-Yu Lu, Jhubei (TW)

(73) Assignee: SITRONIX TECHNOLOGY CORPORATION, Jhubei (TW)

( * ) Notice: Subject to any disclaimer, the term of this patent is extended or adjusted under 35 U.S.C. 154(b) by 50 days.

(21) Appl. No.: 15/138,434

(22) Filed: Apr. 26, 2016

(65) Prior Publication Data

US 2017/0221444 A1 Aug. 3, 2017

(30) Foreign Application Priority Data

Feb. 1, 2016 (TW) ..... 105103165

(51) Int. Cl.
*G09G 3/36* (2006.01)

(52) U.S. Cl.
CPC ..... *G09G 3/3696* (2013.01); *G09G 3/3677* (2013.01)

(58) Field of Classification Search
CPC ..... G09G 3/3674
See application file for complete search history.

(56) References Cited

U.S. PATENT DOCUMENTS 5,578,957 A * 11/1996 Erhart ..... G09G 3/3688 327/333
5,811,992 A * 9/1998 D'Souza ..... H03K 19/0963 326/31
5,953,003 A * 9/1999 Kwon ..... G09G 3/22 345/204

(Continued)

FOREIGN PATENT DOCUMENTS

CN 1713266 A 12/2005
CN 101682720 A 3/2010

(Continued)

OTHER PUBLICATIONS

Kao et al, Subthreshold Leakage Modeling and Reduction Techniques, IEEE 2002, pp. 141-148, (Year: 2002).*
Chowdhury et al, A New Leakage Reduction Method for Ultra Low Power VLSI Design for Portable Devices, 2012 2nd International conference on Power, Control and Embedded Systems, pp. 1-4, (Year: 2012).*
Harsha, Sub-Threshold Leakage Current Reduction Techniques in VLSI Circuits—A Survey, Int. Journal of Engineering Research and Applications, vol. 5, Issue 9, (Part-1), Sep. 2015, pp. 28-32, (Year: 2015).*

(Continued)

*Primary Examiner* — Dorothy Harris
(74) *Attorney, Agent, or Firm* — Locke Lord LLP; Tim Tingkang Xia, Esq.

(57) ABSTRACT

This disclosure provides a gate driving circuit, which comprises: first P-channel, second P-channel, first N-channel and second N-channel transistors, each has a gate, a source, a drain, and a base connected to the source; an output terminal electrically connected to the drains of the second N-channel and P-channel transistors; wherein the source of the first P-channel transistor is connected to a first voltage source, and a first voltage is applied to its gate; the source of the first N-channel transistor is connected to a second voltage source, and a second voltage is applied to its gate; the source of the second P-channel transistor is connected to the drain of the first P-channel transistor, and a third voltage is applied to its gate; the source of the second N-channel transistor is connected to the drain of the first N-channel transistor, and a control voltage is applied to its gate.

14 Claims, 4 Drawing Sheets

(56) References Cited

U.S. PATENT DOCUMENTS 6,140,864 A * 10/2000 Hirata ..... G06F 1/26 327/530
6,157,361 A * 12/2000 Kubota ..... G09G 3/3674 257/E27.111
6,292,183 B1 * 9/2001 Yamazaki ..... H01L 27/12 257/E27.111
6,351,176 B1 * 2/2002 Houston ..... G11C 7/062 327/534
6,549,184 B1 * 4/2003 Koyama ..... G09G 3/3674 345/92
7,327,169 B2 * 2/2008 Osame ..... G11C 19/00 326/108
7,928,702 B2 4/2011 Salato et al.
9,025,404 B1 * 5/2015 Signh ..... G11C 11/412 365/189.08
10,032,425 B2 * 7/2018 Yi ..... G11C 19/287
2002/0000965 A1 * 1/2002 Ando ..... G09G 3/3677 345/87
2005/0285113 A1 * 12/2005 Miyazawa ..... H03K 19/00315 257/72
2008/0174359 A1 * 7/2008 Osada ..... H03K 19/0008 327/534
2014/0146026 A1 * 5/2014 Yu ..... G09G 3/3677 345/208
2017/0162152 A1 * 6/2017 Zhao ..... G09G 3/3677
2017/0162153 A1 * 6/2017 Zhao ..... G09G 3/3677

FOREIGN PATENT DOCUMENTS

CN 105096891 A 11/2015
JP 2005070630 A 3/2005
JP 4431319 B2 3/2010
TW 201541847 A 11/2015

OTHER PUBLICATIONS

Hu, Chapter 7 MOSFETs in ICs—Scaling, Leakage, and Other Topics, 2009, pp. 259-289, (Year: 2009).*
Lee, A Review of MOS Device Physics, Sep. 2002, pp. 1-33. (Year: 2002).*
Orsi, 3. Transistors, Oct. 2009, pp. 1-9 (Year: 2009).*

* cited by examiner

GATE DRIVING CIRCUIT

CROSS REFERENCE TO RELATED APPLICATION

This application claims the benefit of Taiwan application Serial No. 105103165, filed Feb. 1, 2016, the disclosure of which is incorporated by reference herein in its entirety.

FIELD OF THE INVENTION

The present invention relates to a gate driving circuit, and more particularly, to a gate driving circuit realized by transistors with low withstand voltages to drive thin-film transistors in a thin-film-transistor liquid-crystal display (TFT-LCD).

BACKGROUND OF THE INVENTION

In the operation of TFT-LCD, a gate driving circuit is used to provide a sufficient voltage to drive TFTs in the pixels, so as to turn the pixels on or off. Then, a source driving circuit outputs voltage to determine gray scales of the pixels.

There are various withstand-voltage types of transistors in an integrated-circuit LCD driver chip, and the nominal voltage range that each type of transistors can withstand would be updated due to advances of the semiconductor device technology. In the state of the art, a low-voltage transistor can withstand a voltage in the range between 1.5 and 1.8 volts, a medium-voltage transistor can withstand a voltage in the range between 5 and 6 volts, and a high-voltage transistor can withstand a voltage in the range between 25 and 30 volts. To drive a TFT in the TFT-LCD, high-voltage transistors are usually included in the gate driving circuit. However, the high-voltage transistors would introduce more masks and processes in the fabrication of the LCD driver chip, resulting in a higher cost. Therefore, it is in need of a new and advanced gate driving circuit.

SUMMARY OF THE INVENTION

According to one aspect of the present disclosure, one embodiment provides a gate driving circuit, which comprises: m P-channel transistors and m N-channel transistors including a first P-channel transistor, a second P-channel transistor, a first N-channel transistor and a second N-channel transistor, each of the transistors has a gate, a source, a drain, and a base connected to the source, wherein m is an integer larger than 1; an output terminal electrically connected to the drain of the second N-channel transistor and to the drain of the second P-channel transistor; wherein the source of the first P-channel transistor is connected to a first voltage source, and a first control voltage is applied to its gate; the source of the first N-channel transistor is connected to a second voltage source, and a second control voltage is applied to its gate; the source of the second P-channel transistor is connected to the drain of the first P-channel transistor, and a third control voltage is applied to its gate; the source of the second N-channel transistor is connected to the drain of the first N-channel transistor, and a fourth control voltage is applied to its gate; wherein the control voltages are configured so that either the m P-channel transistors are turned on and the m N-channel transistors are turned off or the m N-channel transistors are turned on and the m P-channel transistors are turned off.

According to another aspect of the present disclosure, one embodiment provides a gate driving circuit, which comprises: a first P-channel transistor, a second P-channel transistor, a third P-channel transistor, a first N-channel transistor, a second N-channel transistor and a third N-channel transistors, each of the transistors has a gate, a source, a drain, and a base connected to the source; an output terminal electrically connected to the drain of the third N-channel transistor and to the drain of the third P-channel transistor; wherein the source of the first P-channel transistor is connected to a first voltage source, and a first control voltage is applied to its gate; the source of the first N-channel transistor is connected to a second voltage source, and a second control voltage is applied to its gate; the source of the second P-channel transistor is connected to the drain of the first P-channel transistor, and a third control voltage is applied to its gate; the source of the second N-channel transistor is connected to the drain of the first N-channel transistor, and a fourth control voltage is applied to its gate; the source of the third P-channel transistor is connected to the drain of the second P-channel transistor, and a fifth control voltage is applied to its gate; wherein the source of the third N-channel transistor is connected to the drain of the second N-channel transistor, and a sixth control voltage is applied to its gate; wherein the drains of the third N-channel transistor and the third P-channel transistor are electrically connected to the output terminal; wherein the control voltages are configured so that either the P-channel transistors are turned on and the N-channel transistors are turned off or the N-channel transistors are turned on and the P-channel transistors are turned off.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

In the following embodiments of the present disclosure, when an element is described to be disposed above/mounted on top of or below/under another element, it comprises either the element is directly or indirectly disposed above/below the other element, i.e. when indirectly, there can be some other element arranged between the two; and when directly, there is no other element disposed between the two. It is noted that the descriptions in the present disclosure relate to "above" or "below" are based upon the related diagrams provided, but are not limited thereby. Moreover, the terms "first", "second", and "third", and so on, are simply used for clearly identifying different elements of the same nature, but those elements are not restricted thereby and must be positioned or arranged accordingly. In addition, the size or thickness of each and every element provided in the following diagrams of the present disclosure is only schematic representation used for illustration and may not represent its actual size.

The gate driving circuits disclosed in the embodiments may be used to drive thin-film transistors in a liquid-crystal display. Each of the gate driving circuits is provided with two voltage sources and includes m P-channel transistors in series and m N-channel transistors in series; wherein, m is an integer equal to or larger than 2. In other words, the P-channel transistors are m in number and the N-channel transistors are m in number. The number m depends on the withstand voltages or breakdown voltages of the P-channel and N-channel transistors as well as the voltage difference between the two voltage sources. In the present disclosure, the gate driving circuits may have applications in which the voltage difference between the two voltage sources is larger than the withstand voltages of the P-channel and N-channel transistors.

Figure 1:
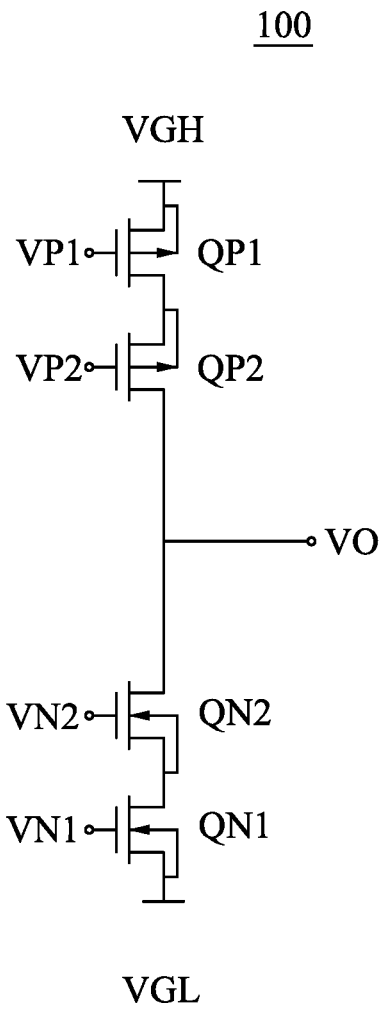
FIG. 1 is a block diagram of a gate driving circuit according to a first embodiment of the present disclosure.

Please refer to FIG. 1, which is a block diagram of a gate driving circuit 100 according to a first embodiment of the present disclosure. Wherein, there are two P-channel transistors and two N-channel transistors; i.e. m equals 2. The gate driving circuit 100 includes a first P-channel transistor QP1, a second P-channel transistor QP2, a first N-channel transistor QN1 and a second N-channel transistor QN2, and each of the transistors QP1, QP2, QN1 and QN2 is a four-terminal device with gate, source, drain and base terminals. Preferably, the transistors QP1 and QP2 are P-channel metal-oxide-semiconductor field-effect transistors (P-MOSFET), and the transistors QN1 and QN2 are N-channel metal-oxide-semiconductor field-effect transistors (N-MOSFET). In each of the transistors QP1, QP2, QN1 and QN2, the base is connected to the source to avoid the so-called "body effect", making the P-channel transistors QP1 and QP2 are equal in device characteristics and the N-channel transistors QN1 and QN2 are equal in device characteristics, too.

As shown in FIG. 1, the gate driving circuit 100 is provided with two voltage sources (the first voltage source VGH and the second voltage source VGL) and four control voltages (the first control voltage VP1, the second control voltage VN1, the third control voltage VP2 and the fourth control voltage VN2). With regard to the first P-channel transistor QP1, the source is connected to the first voltage source VGH and the gate is connected to the first control voltage VP1. With regard to the second P-channel transistor QP2, the source is connected to the drain of the first P-channel transistor QP1 and the gate is connected to the third control voltage VP2. With regard to the first N-channel transistor QN1, the source is connected to the second voltage source VGL and the gate is connected to the second control voltage VN1. With regard to the second N-channel transistor QN2, the source is connected to the drain of the first N-channel transistor QN1 and the gate is connected to the fourth control voltage VN2. In addition, the drains of the second N-channel transistor QN2 and the second P-channel transistor QP2 are connected to form a connection terminal, which may act as an output terminal VO of the gate driving circuit 100.

Figure 2:
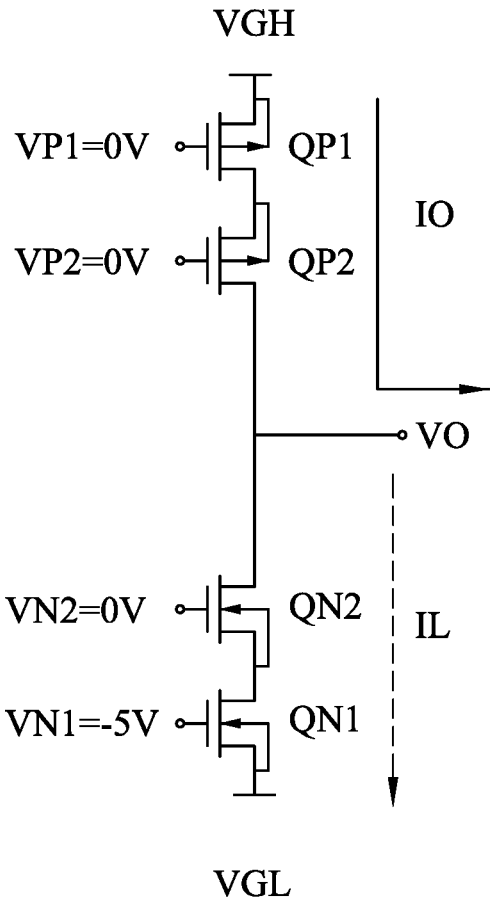
FIG. 2 schematically shows the related voltages and currents in the gate driving circuit when its output voltage is Vgh in the first embodiment.

In an exemplary embodiment, the first voltage source VGH provides a fixed voltage Vgh of +5 volts and the second voltage source VGL provides another fixed voltage Vgl of −5 volts. A pre-determined voltage Vt can be set to be (Vgh−Vgl)/m, i.e. Vt=5 volts because m=2. To have an output voltage of Vgh (+5 volts) at the output terminal VO of the gate driving circuit 100, the P-channel transistors QP1 and QP2 should be turned on and the N-channel transistors QN1 and QN2 should be turned off by applying proper control voltages VP1, VN1, VP2 and VN2. For example, the first control voltage VP1 and the third control voltage VP2 are set to be Vgh−Vt=0 volt, the second control voltage VN1 is set to be Vgl=−5 volts, and the fourth control voltage VN2 is set to be Vgl+Vt=0 volt. Because the P-channel transistors QP1 and QP2 stay in the "ON" state and the N-channel transistors QN1 and QN2 stay in the "OFF" state, Vgh=+5 volts can be produced at the output terminal VO of the gate driving circuit 100. In such a condition, an output current 10 may flow from the first voltage source VGH to the output terminal VO through the P-channel transistors QP1 and QP2, and a leakage current IL may flow from the output terminal VO to the second voltage source VGL through the N-channel transistors QN2 and QN1, as shown in FIG. 2. In consequence, Vsd equals 0 volt, Vsg equals 5 volts, and Vgd equals −5 volts in the first P-channel transistors QP1; Vsd equals 0 volt, Vsg equals 5 volts, and Vgd equals −5 volts in the second P-channel transistors QP2; Vgs equals 0 volt and both Vdg and Vds equal 5 volts in the first N-channel transistors QN1; Vgs equals 0 volt and both Vdg and Vds equal 5 volts in the second N-channel transistors QN2. Wherein, with regard to a P-channel transistor, Vsg denotes the voltage difference between the source and the gate, Vgd denotes the voltage difference between the gate and the drain, and Vsd denotes the voltage difference between the source and the drain; while with regard to an N-channel transistor, Vgs denotes the voltage difference between the gate and the source, Vdg denotes the voltage difference between the drain and the gate, and Vds denotes the voltage difference between the drain and the source.

In an exemplary embodiment, the first voltage source VGH provides a fixed voltage Vgh of +5 volts and the second voltage source VGL provides another fixed voltage Vgl of −5 volts. A pre-determined voltage Vt can be set to be (Vgh−Vgl)/m, i.e. Vt=5 volts because m=2. To have an output voltage of Vgh (+5 volts) at the output terminal VO of the gate driving circuit 100, the P-channel transistors QP1 and QP2 should be turned on and the N-channel transistors QN1 and QN2 should be turned off by applying proper control voltages VP1, VN1, VP2 and VN2. For example, the first control voltage VP1 and the third control voltage VP2 are set to be Vgh−Vt=0 volt, the second control voltage VN1 is set to be Vgl=−5 volts, and the fourth control voltage VN2 is set to be Vgl+Vt=0 volt. Because the P-channel transistors QP1 and QP2 stay in the "ON" state and the N-channel transistors QN1 and QN2 stay in the "OFF" state, Vgh=+5 volts can be produced at the output terminal VO of the gate driving circuit 100. In such a condition, an output current IO may flow from the first voltage source VGH to the output terminal VO through the P-channel transistors QP1 and QP2, and a leakage current IL may flow from the output terminal VO to the second voltage source VGL through the N-channel transistors QN2 and QN1, as shown in FIG. 2. In consequence, Vsd equals 0 volt, Vsg equals 5 volts, and Vgd equals −5 volts in the first P-channel transistors QP1; Vsd equals 0 volt, Vsg equals 5 volts, and Vgd equals −5 volts in the second P-channel transistors QP2; Vgs equals 0 volt and both Vdg and Vds equal 5 volts in the first N-channel transistors QN1; Vgs equals 0 volt and both Vdg and Vds equal 5 volts in the second N-channel transistors QN2. Wherein, with regard to a P-channel transistor, Vsg denotes the voltage difference between the source and the gate, Vgd denotes the voltage difference between the gate and the drain, and Vsd denotes the voltage difference between the source and the drain; while with regard to an N-channel transistor, Vgs denotes the voltage difference between the gate and the source, Vdg denotes the voltage difference between the drain and the gate, and Vds denotes the voltage difference between the drain and the source.

Figure 3:
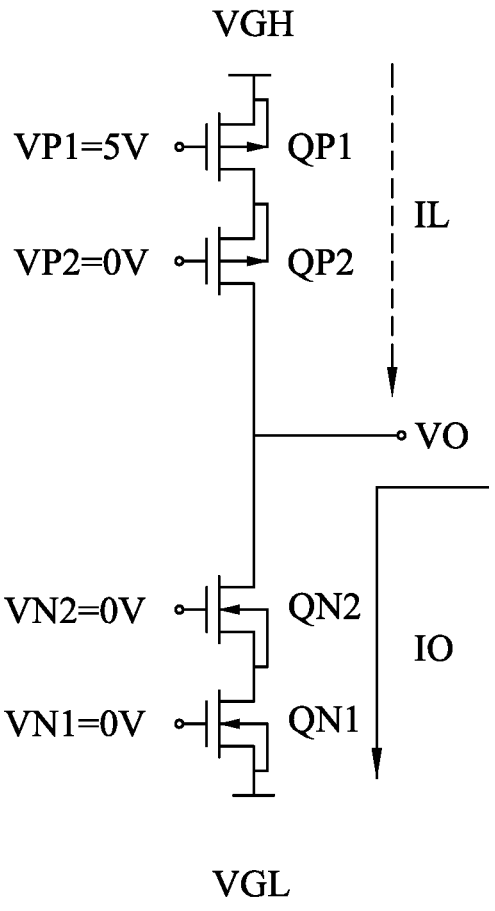
FIG. 3 schematically shows the related voltages and currents in the gate driving circuit when its output voltage is Vgl in the first embodiment.

On the other respect, to have an output voltage of Vgl (−5 volts) at the output terminal VO of the gate driving circuit 100, the P-channel transistors QP1 and QP2 should be turned off and the N-channel transistors QN1 and QN2 should be turned on by applying proper control voltages VP1, VN1, VP2 and VN2. For example, the first control voltage VP1 is set to be Vgh=+5 volts, the second control voltage VN1 and the fourth control voltage VN2 are set to be Vgl+Vt=0 volt, and the third control voltage VP2 is set to be Vgl−Vt=0 volt. Because the P-channel transistors QP1 and QP2 stay in the "OFF" state and the N-channel transistors QN1 and QN2 stay in the "ON" state, Vgl=−5 volts can be produced at the output terminal VO of the gate driving circuit 100. In such a condition, an output current IO may flow from the output terminal VO to the second voltage source VGL through the N-channel transistors QN2 and QN1, and a leakage current IL may flow from the first voltage source VGH to the output terminal VO through the P-channel transistors QP1 and QP2, as shown in FIG. 3. In consequence, Vds equals 0 volt and both Vgs and Vgd equal 5 volts in the first N-channel transistors QN1; Vds equals 0 volt and both Vgs and Vgd equal 5 volts in the second N-channel transistors QN2; Vsg equals 0 volt, and both Vgd and Vsd equal 5 volts in the first P-channel transistors QP1; Vsg equals 0 volt, and both Vgd and Vsd equal 5 volts in the second P-channel transistors QP2.

Figure 4:
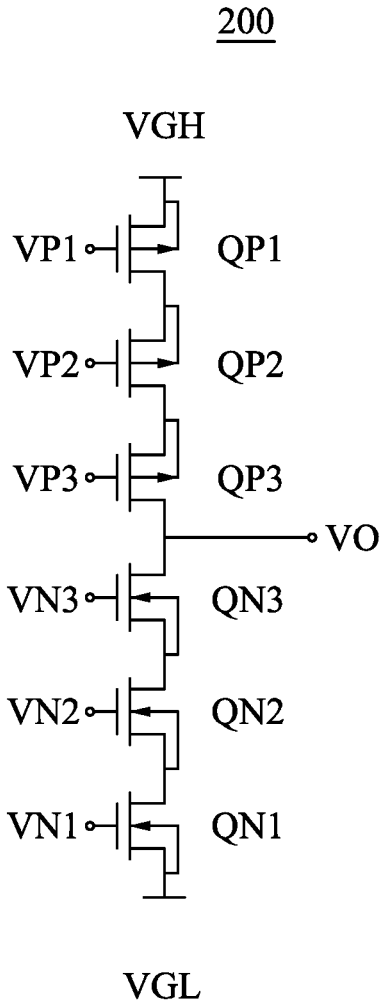
FIG. 4 is a block diagram of a gate driving circuit according to a second embodiment of the present disclosure.

Please refer to FIG. 4, which is a block diagram of a gate driving circuit 200 according to a second embodiment of the present disclosure. Wherein, there are three P-channel transistors and three N-channel transistors; i.e. m equals 3. The gate driving circuit 100 includes a first P-channel transistor QP1, a second P-channel transistor QP2, a third P-channel transistor QP3, a first N-channel transistor QN1, a second N-channel transistor QN2 and a third N-channel transistor QN, and each of the transistors QP1, QP2, QP3, QN1, QN2 and QN3 is a four-terminal device with gate, source, drain and base terminals. Preferably, the transistors QP1, QP2 and QP3 are P-MOSFET, and the transistors QN1, QN2 and QN3 are N-MOSFET. In each of the transistors QP1, QP2, QP3, QN1, QN2 and QN3, the base is connected to the source to avoid the so-called "body effect", making the P-channel transistors QP1, QP2 and QP3 are equal in device characteristics and the N-channel transistors QN1, QN2 and QN3 are equal in device characteristics, too.

As shown in FIG. 4, the gate driving circuit 200 is provided with two voltage sources (the first voltage source VGH and the second voltage source VGL) and six control voltages (the first control voltage VP1, the second control voltage VN1, the third control voltage VP2, the fourth control voltage VN2, the fifth control voltage VP3 and the sixth control voltage VN3). With regard to the first P-channel transistor QP1, the source is connected to the first voltage source VGH and the gate is connected to the first control voltage VP1. With regard to the second P-channel transistor QP2, the source is connected to the drain of the first P-channel transistor QP1 and the gate is connected to the third control voltage VP2. With regard to the third P-channel transistor QP3, the source is connected to the drain of the second P-channel transistor QP2 and the gate is connected to the fifth control voltage VP3. With regard to the first N-channel transistor QN1, the source is connected to the second voltage source VGL and the gate is connected to the second control voltage VN1. With regard to the second N-channel transistor QN2, the source is connected to the drain of the first N-channel transistor QN1 and the gate is connected to the fourth control voltage VN2. With regard to the third N-channel transistor QN3, the source is connected to the drain of the second N-channel transistor QN2 and the gate is connected to the sixth control voltage VN3. In addition, the drains of the third N-channel transistor QN3 and the third P-channel transistor QP3 are connected to form a connection terminal, which may act as an output terminal VO of the gate driving circuit 200.

Figure 5:
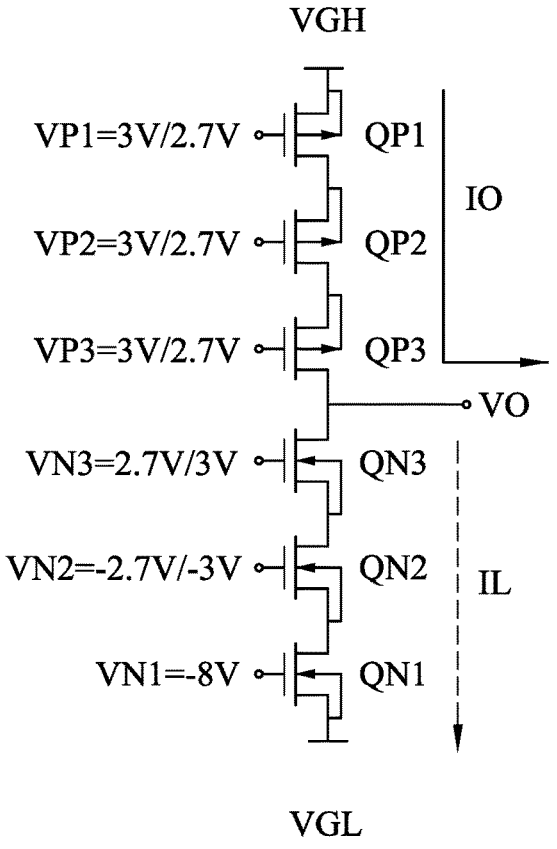
FIG. 5 schematically shows the related voltages and currents in the gate driving circuit when its output voltage is Vgh in the second embodiment.

In an exemplary embodiment, the first voltage source VGH provides a fixed voltage Vgh of +8 volts and the second voltage source VGL provides another fixed voltage Vgl of −8 volts. A pre-determined voltage Vt can be set to be (Vgh−Vgl)/m, i.e. Vt is about 5.3 volts because m=3. To have an output voltage of Vgh (+8 volts) at the output terminal VO of the gate driving circuit 200, the P-channel transistors QP1, QP2 and QP3 should be turned on and the N-channel transistors QN1, QN2 and QN3 should be turned off by applying proper control voltages VP1, VN1, VP2, VN2, VP3 and VN3. For example, the first control voltage VP1, the third control voltage VP2 and the fifth control voltage VP3 are all set to be Vgh−Vt (about 2.7 volts), the second control voltage VN1 is set to be Vgl=−8 volts, the fourth control voltage VN2 is set to be Vgl+Vt (about −2.7 volts), and the sixth control voltage VN3 is set to be Vgl+2Vt (about 2.7 volts). Because the P-channel transistors QP1, QP2 and QP3 stay in the "ON" state and the N-channel transistors QN1, QN2 and QN3 stay in the "OFF" state, Vgh=+8 volts can be produced at the output terminal VO of the gate driving circuit 200. In such a condition, an output current 10 may flow from the first voltage source VGH to the output terminal VO through the P-channel transistors QP1, QP2 and QP3, and a leakage current IL may flow from the output terminal VO to the second voltage source VGL through the N-channel transistors QN3, QN2 and QN1, as shown in FIG. 5. In consequence, Vsd equals 0 volt, Vsg is about 5.3 volts, and Vgd is about −5.3 volts in each of the P-channel transistors QP1, QP2 and QP3; Vgs equals 0 volt and both Vdg and Vds are about 5.3 volts in the N-channel transistors QN1, QN2 and QN3.

In an exemplary embodiment, the first voltage source VGH provides a fixed voltage Vgh of +8 volts and the second voltage source VGL provides another fixed voltage Vgl of −8 volts. A pre-determined voltage Vt can be set to be (Vgh−Vgl)/m, i.e. Vt is about 5.3 volts because m=3. To have an output voltage of Vgh (+8 volts) at the output terminal VO of the gate driving circuit 200, the P-channel transistors QP1, QP2 and QP3 should be turned on and the N-channel transistors QN1, QN2 and QN3 should be turned off by applying proper control voltages VP1, VN1, VP2, VN2, VP3 and VN3. For example, the first control voltage VP1, the third control voltage VP2 and the fifth control voltage VP3 are all set to be Vgh−Vt (about 2.7 volts), the second control voltage VN1 is set to be Vg1=−8 volts, the fourth control voltage VN2 is set to be Vgl+Vt (about −2.7 volts), and the sixth control voltage VN3 is set to be Vgl+2Vt (about 2.7 volts). Because the P-channel transistors QP1, QP2 and QP3 stay in the "ON" state and the N-channel transistors QN1, QN2 and QN3 stay in the "OFF" state, Vgh=+8 volts can be produced at the output terminal VO of the gate driving circuit 200. In such a condition, an output current IO may flow from the first voltage source VGH to the output terminal VO through the P-channel transistors QP1, QP2 and QP3, and a leakage current IL may flow from the output terminal VO to the second voltage source VGL through the N-channel transistors QN3, QN2 and QN1, as shown in FIG. 5. In consequence, Vsd equals 0 volt, Vsg is about 5.3 volts, and Vgd is about −5.3 volts in each of the P-channel transistors QP1, QP2 and QP3; Vgs equals 0 volt and both Vdg and Vds are about 5.3 volts in the N-channel transistors QN1, QN2 and QN3.

Figure 6:
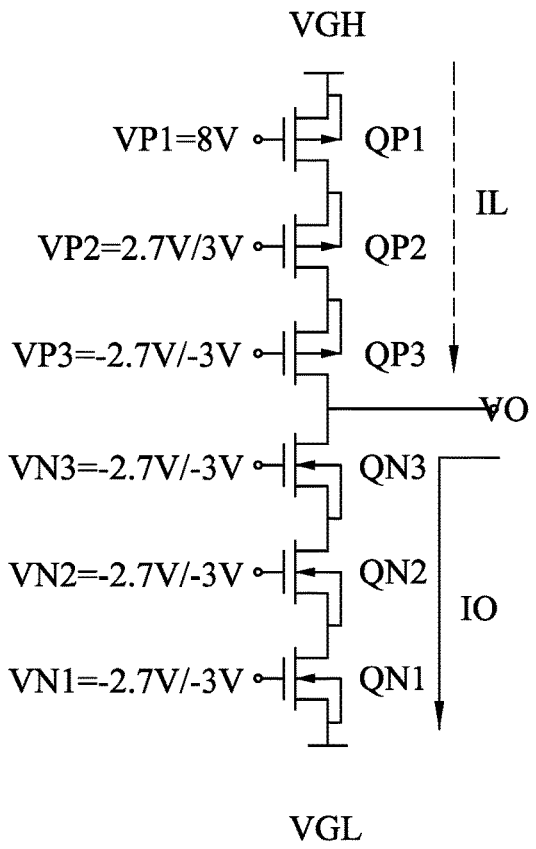
FIG. 6 schematically shows the related voltages and currents in the gate driving circuit when its output voltage is Vgl in the second embodiment.

On the other respect, to have an output voltage of Vgl (−8 volts) at the output terminal VO of the gate driving circuit 200, the P-channel transistors QP1, QP2 and QP3 should be turned off and the N-channel transistors QN1, QN2 and QN3 should be turned on by applying proper control voltages VP1, VN1, VP2, VN2, VP3 and VN3. For example, the first control voltage VP1 is set to be Vgh=+8 volts, the third control voltage VP2 is set to be Vgh−Vt (about 2.7 volts), the fifth control voltage VP3 is set to be Vgh−2Vt (about −2.7 volts), and the second control voltage VN1, the fourth control voltage VN2 and the sixth control voltage VN3 are all set to be Vgl+Vt (about −2.7 volts). Because the P-channel transistors QP1, QP2 and QP3 stay in the "OFF" state and the N-channel transistors QN1, QN2 and QN3 stay in the "ON" state, Vg1=−8 volts can be produced at the output terminal VO of the gate driving circuit 200. In such a condition, an output current IO may flow from the output terminal VO to the second voltage source VGL through the N-channel transistors QN3, QN2 and QN1, and a leakage current IL may flow from the first voltage source VGH to the output terminal VO through the P-channel transistors QP1, QP2 and QP3, as shown in FIG. 6. In consequence, Vsg equals 0 volt, both Vgd and Vsd are about 5.3 volts in each of the P-channel transistors QP1, QP2 and QP3; Vds equals 0 volt and both Vgs and Vgd are about 5.3 volts in the N-channel transistors QN1, QN2 and QN3.

As set forth above, the voltage differences between any two of the gate, source and drain of the transistors QP1, QP2, QP3, QN1, QN2 and QN3 are less than 6 volts in the operation of the gate driving circuit 200; thus, each of the transistors QP1, QP2, QP3, QN1, QN2 and QN3 can be designed and formed by using medium-voltage transistors with withstand voltage between 5 and 6 volts, but not by using high-voltage transistors with withstand voltage between 25 and 30 volts.

Figure 7:
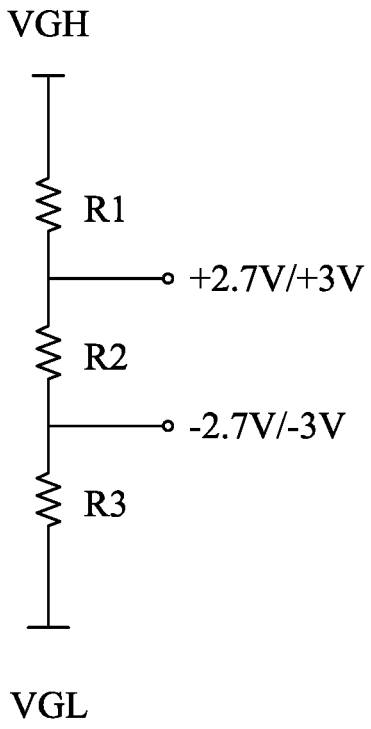
FIG. 7 is a first example of generating the control voltages.

Some examples of generating the control voltages VP1, VN1, VP2, VN2, VP3 and VN3 are provided in the following paragraphs, because these control voltages play important roles in the operation of the gate driving circuit 200. The first one is a voltage divider where resistors R1, R2 and R3 connected in series, as shown in FIG. 7, with Vgh=+8 volts (from the first voltage source VGH) and Vgl=−8 volts (from the second voltage source VGL) applied across the resistors R1, R2 and R3 and the output voltages emerging from the connections among them. In the case where the resistors R1, R2 and R3 have an equal resistance, the output voltages can be about +2.7 and −2.7 volts. In the other case where the resistors R1, R2 and R3 can be designed to have proper resistances, so that the output voltages are +3 and −3 volts. Either +2.7 and −2.7 volts or +3 and −3 volts can be used as the control voltages VP1, VN1, VP2, VN2, VP3 and VN3 of the gate driving circuit 200.

Figure 8:
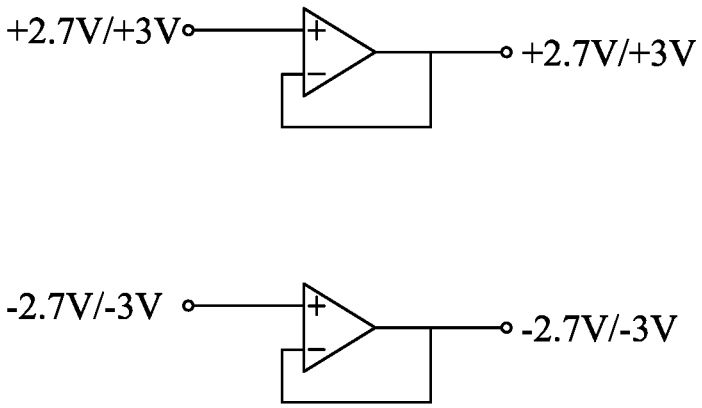
FIG. 8 is a second example of generating the control voltages.

The second example is based on a low drop-out (LDO) regulator. As shown in FIG. 8, if electrical voltages close to +2.7 and −2.7 volts are already in the integrated-circuit chip including the gate driving circuit 200, the LDO regulator can output +2.7 and −2.7 volts. In the other case where either +3 or −3 volts is applied to the LDO regulator, +3 and −3 volts can be obtained at the output. Either +2.7 and −2.7 volts or +3 and −3 volts can be used as the control voltages VP1, VN1, VP2, VN2, VP3 and VN3 of the gate driving circuit 200.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A gate driving circuit comprising:

m P-channel transistors and m N-channel transistors including a first P-channel transistor, a second P-channel transistor, a first N-channel transistor and a second N-channel transistor, each of the transistors has a gate, a source, a drain, and a base connected to the source, wherein m is an integer larger than 1;

an output terminal outputting an output voltage;

wherein the source of the first P-channel transistor is connected to a first voltage source, and a first control voltage is applied to its gate; the source of the first N-channel transistor is connected to a second voltage source, and a second control voltage is applied to its gate; the source of the second P-channel transistor is connected to the drain of the first P-channel transistor, and a third control voltage is applied to its gate; a voltage level of the second control voltage applied to the gate of the first N-channel transistor is different from a voltage level of the third control voltage applied to the gate of the second P-channel transistor; the source of the second N-channel transistor is connected to the drain of the first N-channel transistor, and a fourth control voltage is applied to its gate;

wherein the control voltages are configured so that either the m P-channel transistors are turned on and the m N-channel transistors are turned off or the m N-channel transistors are turned on and the m P-channel transistors are turned off.

2. The gate driving circuit of claim 1 configured for driving thin-film transistors in a liquid-crystal display.

3. The gate driving circuit of claim 1, wherein a voltage difference between the first and second voltage sources is larger than a withstand voltage between any two of the gate, source and drain of the transistors.

4. The gate driving circuit of claim 1, wherein the m P-channel transistors further include a third P-channel transistor and the m N-channel transistors further include a third N-channel transistor; wherein the source of the third P-channel transistor is connected to the drain of the second P-channel transistor, and a fifth control voltage is applied to its gate; wherein the source of the third N-channel transistor is connected to the drain of the second N-channel transistor, and a sixth control voltage is applied to its gate.

5. The gate driving circuit of claim 4, wherein the output voltage at the output terminal equals Vgh when the first, third and fifth control voltages equal Vgh−Vt, the second control voltage equals Vgl, the fourth control voltage equals Vgl+Vt, and the sixth control voltage equals Vgl+2Vt; wherein Vt is a pre-determined voltage set to be (Vgh−Vgl)/m, and Vgh and Vgl respectively denote voltages provided by the first and second voltage sources.

6. The gate driving circuit of claim 4, wherein the output voltage at the output terminal equals Vgl when the first control voltage equals Vgh, the third control voltage equals Vgh−Vt, the fifth control voltage equals Vgh−2Vt, and the second, fourth and sixth control voltages equal Vgl+Vt; wherein Vt is a pre-determined voltage set to be (Vgh−Vgl)/m, and Vgh and Vgl respectively denote voltages provided by the first and second voltage sources.

7. The gate driving circuit of claim 4, wherein the drains of the third N-channel transistor and the third P-channel transistor are electrically connected to the output terminal.

8. The gate driving circuit of claim 1, wherein a voltage provided by the first voltage source is Vgh, a voltage provided by the second voltage source is Vgl and the control voltages are determined according to a pre-determined voltage set to be (Vgh−Vgl)/m for outputting the voltage Vgh or Vgl to the output terminal.

9. The gate driving circuit of claim 1, wherein the output terminal is electrically connected to the drain of the second N-channel transistor and to the drain of the second P-channel transistor.

10. The gate driving circuit of claim 1, wherein the second control voltage applied to the gate of the first N-channel transistor is different from the first control voltage applied to the gate of the first P-channel transistor and the third control voltage applied to the gate of the second P-channel transistor for outputting a voltage provided by the first voltage source to the output terminal.

11. A gate driving circuit comprising:

m P-channel transistors and m N-channel transistors including a first P-channel transistor, a second P-channel transistor, a first N-channel transistor and a second N-channel transistor, each of the transistors has a gate, a source, a drain, and a base connected to the source, wherein m is an integer larger than 1;

an output terminal outputting an output voltage;

wherein the source of the first P-channel transistor is connected to a first voltage source, and a first control voltage is applied to its gate; the source of the first N-channel transistor is connected to a second voltage source, and a second control voltage is applied to its gate; the source of the second P-channel transistor is connected to the drain of the first P-channel transistor, and a third control voltage is applied to its gate; the source of the second N-channel transistor is connected to the drain of the first N-channel transistor, and a fourth control voltage is applied to its gate;

wherein the control voltages are configured so that either the m P-channel transistors are turned on and the m N-channel transistors are turned off or the m N-channel transistors are turned on and the m P-channel transistors are turned off;

wherein the output voltage at the output terminal equals Vgh when the first and third control voltages equal Vgh−Vt, the second control voltage equals Vgl, and the fourth control voltage equals Vgl+Vt; wherein Vt is a pre-determined voltage set to be (Vgh−Vgl)/m, and Vgh and Vgl respectively denote voltages provided by the first and second voltage sources.

12. The gate driving circuit of claim 11, wherein the output terminal is electrically connected to the drain of the second N-channel transistor and to the drain of the second P-channel transistor.

13. A gate driving circuit comprising:

m P-channel transistors and m N-channel transistors including a first P-channel transistor, a second P-channel transistor, a first N-channel transistor and a second N-channel transistor, each of the transistors has a gate, a source, a drain, and a base connected to the source, wherein m is an integer larger than 1;

an output terminal outputting an output voltage;

wherein the source of the first P-channel transistor is connected to a first voltage source, and a first control voltage is applied to its gate; the source of the first N-channel transistor is connected to a second voltage source, and a second control voltage is applied to its gate; the source of the second P-channel transistor is connected to the drain of the first P-channel transistor, and a third control voltage is applied to its gate; the source of the second N-channel transistor is connected to the drain of the first N-channel transistor, and a fourth control voltage is applied to its gate;

wherein the control voltages are configured so that either the m P-channel transistors are turned on and the m N-channel transistors are turned off or the m N-channel transistors are turned on and the m P-channel transistors are turned off;

wherein the output voltage at the output terminal equals Vgl when the first control voltage equals Vgh, the second and fourth control voltages equal Vgl+Vt, and the third control voltage equals Vgh−Vt; wherein Vt is a pre-determined voltage set to be (Vgh−Vgl)/m, and Vgh and Vgl respectively denote voltages provided by the first and second voltage sources.

14. The gate driving circuit of claim 13, wherein the output terminal is electrically connected to the drain of the second N-channel transistor and to the drain of the second P-channel transistor.

* * * * *